US006231150B1

(12) United States Patent
Ito

(10) Patent No.: US 6,231,150 B1
(45) Date of Patent: May 15, 2001

(54) INK-JET PRINTING CONTROL HAVING PRINTING HEAD DRIVEN BY TWO SUCCESSIVE DRIVE PULSES

(75) Inventor: Masaharu Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/058,857

(22) Filed: Apr. 13, 1998

(30) Foreign Application Priority Data

Apr. 14, 1997 (JP) ..... 9-111866

(51) Int. Cl.[7] ..... B41J 28/39
(52) U.S. Cl. ..... 347/11; 347/11; 347/10
(58) Field of Search ..... 347/11, 68, 94, 347/10

(56) References Cited

U.S. PATENT DOCUMENTS

| | | | |
|---|---|---|---|
| 4,879,568 | 11/1989 | Bartky et al. | 347/69 |
| 4,887,100 | 12/1989 | Michaelis et al. | 347/69 |
| 4,992,808 | 2/1991 | Bartky et al. | 347/69 |
| 5,003,679 | 4/1991 | Bartky et al. | 29/25.35 |
| 5,028,936 | 7/1991 | Bartky et al. | 347/69 |
| 5,359,350 * | 10/1994 | Nakano et al. | 347/10 |
| 5,600,350 * | 2/1997 | Cobbs et al. | 347/19 |
| 5,680,163 * | 10/1997 | Sugahara | 347/71 |

FOREIGN PATENT DOCUMENTS 63-247051 10/1988 (JP) .

* cited by examiner

*Primary Examiner*—John Barlow
*Assistant Examiner*—Alfred Dudding
(74) *Attorney, Agent, or Firm*—Oliff & Berridge PLC.

(57) ABSTRACT

In an ink-jet printing apparatus, a first drive pulse is applied to an actuator of a printing head and then a second drive pulse is applied to the same actuator of the printing head. The second drive pulse has a magnitude equal to that of the first drive pulse and a pulse width equal to approximately 0.20 to 0.40 times the one-way propagation time T of pressure wave in an ink channel and the second drive pulse is terminated within a range of approximately 2.60 to 2.80 times the one-way propagation time T from an end time of the first drive pulse. This control suppresses effectively the residual pressure wave vibration thereby to reduce variations in the ink ejection speed even when the actuator driving frequency changes.

15 Claims, 6 Drawing Sheets

| β \ α | 2.50T | 2.60T | 2.65T | 2.70T | 2.75T | 2.80T | 2.90T |
|---|---|---|---|---|---|---|---|
| 0.15T | × | × | × | × | × | × | × |
| 0.20T | × | △ | ○ | ○ | △ | △ | × |
| 0.25T | △ | ○ | ◎ | ◎ | ○ | △ | × |
| 0.30T | × | ○ | ◎ | ◎ | ◎ | △ | × |
| 0.35T | × | △ | ○ | ◎ | ◎ | ○ | × |
| 0.40T | × | △ | △ | △ | ○ | ○ | × |
| 0.45T | × | × | × | △ | △ | △ | × |
| 0.50T | × | × | × | × | × | × | × |

◎ : ΔV ≦ 1.0m/s
○ : 1.0 < ΔV ≦ 1.5 m/s
△ : 1.5 < ΔV ≦ 2.0 m/s
× : 2.0m/s < ΔV

INK-JET PRINTING CONTROL HAVING PRINTING HEAD DRIVEN BY TWO SUCCESSIVE DRIVE PULSES

CROSS REFERENCE TO RELATED APPLICATION

This application relates to and incorporates herein by reference Japanese patent application No. 9-111866 filed on Apr. 14, 1997.

BACKGROUND OF THE INVENTION

1. Field of the Invention

The present invention relates to ink-jet printing control for printing by ejecting ink droplets onto print media, and more particularly to an ink-jet printing control which is capable of providing stable performance of ink droplet ejection.

2. Description of Related Art

Among conventional ink-jet printing apparatuses, there is a drop-on-demand arrangement of a shear mode type using piezoelectric ceramic material as disclosed in Japanese Unexamined Patent Publication No. 63-247051. A printing head used in this kind of ink-jet printing apparatus is shown in FIGS. 8A and 8B.

Referring to FIGS. 8A and 8B, a printing head 21 is provided with a cover plate 201 and a base plate 202 which is provided facing the cover plate 201. A part between the cover plate 201 and the base plate 202 is formed with piezoelectric material so that partitions are provided by a plurality of shear mode actuator walls 203 polarized in arrow directions F30 and F40 indicated in FIG. 8A, and an ink channel 205 and an air channel 212 are arranged alternately between each pair of shear mode actuator walls 203. One side of each shear mode actuator wall 203 has a film electrode 204, and the other side thereof has a film electrode 214.

As shown in FIG. 8B, the front end of the shear mode actuator wall 203 is provided with a nozzle plate 207 which has nozzles 206 each of which is connected with the ink channel 205, and the rear end of the shear mode actuator wall 203 is provided with a manifold part 209 which has a filler part 208 for preventing intrusion of ink from a common ink passage 213 into the air channel 212. The manifold part 209 is used for distributing ink from an ink reservoir (not shown) to each ink channel 205. Each of the electrodes 204 and 214 is covered with an insulating layer (not shown), and the electrode 214 facing the air channel 212 is connected with the ground 211. The electrode 204 forming the ink channel 205 is connected with a head driver IC (integrate circuit) 83 which applies an actuator drive signal to the electrodes 204 and 214.

In the printing head 21 structured as mentioned above, when the head driver IC 83 applies the actuator drive signal 110 having a pulse width T shown in FIG. 10 to the electrode 204, piezoelectric thickness slip deformation occurs on each shear mode actuator wall 203 to increase a volume of the ink channel 205. For instance, as shown in FIG. 9, when a positive drive voltage is applied to the electrode 204 of the ink channel 205, electric fields are produced on the shear mode actuator wall 203 in arrow directions F10 and F20, causing piezoelectric thickness slip deformation to occur on upper walls 203*a* and lower walls 203*b* of the shear mode actuator wall 203 so that the volume of the ink channel 205 is increased. At this step of operation, pressure in the ink channel 205 including a vicinal part of the nozzle 206 is decreased. This state is maintained during the pulse width T which corresponds a period of one-way propagation time T of a pressure wave in the ink channel 205. Thus, ink is supplied from the common ink passage 213 thereinto.

The one-way propagation time T of the actuator drive signal 110 indicates a period of time required for the pressure wave in the ink channel 205 to complete propagation in the longitudinal direction of the ink channel 205. Using length 'L' (FIG. 8B) of the ink channel 205 in the longitudinal direction thereof and acoustic velocity 'a' in ink in the ink channel 205, 'T' is expressed as follows; T=L/a.

Based on the principle of pressure wave propagation, pressure in the ink channel 205 is reversed to become positive after a lapse of time T following application of the drive voltage. At the timing of pressure reversal, the drive voltage being applied to the electrode 204 of the ink channel 205 is reset to zero (0) V. Thus, the shear mode actuator wall 203 is restored to normal (FIGS. 8A and 8B), applying pressure to ink. At this step of operation, the positive pressure is added to pressure which has been produced by restoration of the shear mode actuator wall 203 to normal, so that relatively high pressure is generated in the vicinity of the nozzle 206 in the ink channel 205, thereby ejecting ink from the ink channel 205 to the outside through the nozzle 206.

In actual use, the printing head 21 is mounted on a carriage which is electrically driven by a motor to move transversely across the printable medium during the printing operation. As the motor speed changes greatly at the time of starting and ending an energization of the motor, the moving speed of the printing head 21 relative to the printable medium changes correspondingly. Further, the moving speed of the printing head 21 changes, even during the constant speed rotation of the motor, due to other causes such as friction between the carriage and a carriage shaft supporting the carriage movably thereon. As a result, even if the drive pulse signal 110 is applied at a fixed driving interval (fixed frequency), the actual driving interval varies when the transverse moving speed of the printing head relative to the printable medium changes.

According to measurement of the ink ejection speed against the driving interval of the drive pulse signal 110, as shown in FIG. 7, the ink ejection speed changes between the highest speed (9.00 m/s) at a driving interval of 110 $\mu$s and the lowest speed (6.25 m/s) at another driving interval of 125 $\mu$s. Thus, the maximum change in the ink ejection speed is 2.75 m/s.

The above variation in the driving interval of the actuator drive pulse signal 110 thus causes variations in the ink ejection speed of the printing head 21 due to a residual pressure wave vibration in the ink chamber 205. This results in degradation in the printing quality.

SUMMARY OF THE INVENTION

It is therefore an object of the present invention to provide an ink-jet printing control which is capable of delivering stable ejection of ink droplets to ensure satisfactory printing quality.

It is a further object of the present invention to provide an ink-jet printing control which is capable of suppressing variation in ink ejection speed against variation in driving interval of a drive pulse signal.

According to the present invention, a drive pulse signal applied to an actuator of a printing head for each ink ejection operation includes a first drive pulse and a second pulse. The first drive pulse changes a volume of an ink channel to eject ink from the ink channel. The second drive pulse has a wave height equal to that of the first drive pulse and a pulse width equal to approximately 0.20 to 0.40 times the one-way propagation time T of pressure wave in the ink channel. The second drive pulse is applied to the actuator so that it ends within a range of approximately 2.60 to 2.80 times the one-way propagation time T from a fall time of the first drive pulse signal. Thus, residual pressure wave oscillation in the ink channel can be suppressed to ensure stable ink droplet ejection, thereby making it possible to attain satisfactory quality of printing.

BRIEF DESCRIPTION OF THE DRAWINGS

Other objects, features and advantages of the present invention will be made more apparent from the following detailed description with reference to various embodiments shown in the accompanying drawings. In the drawings.

DETAILED DESCRIPTION OF THE PREFERRED EMBODIMENT

Figure 8A:
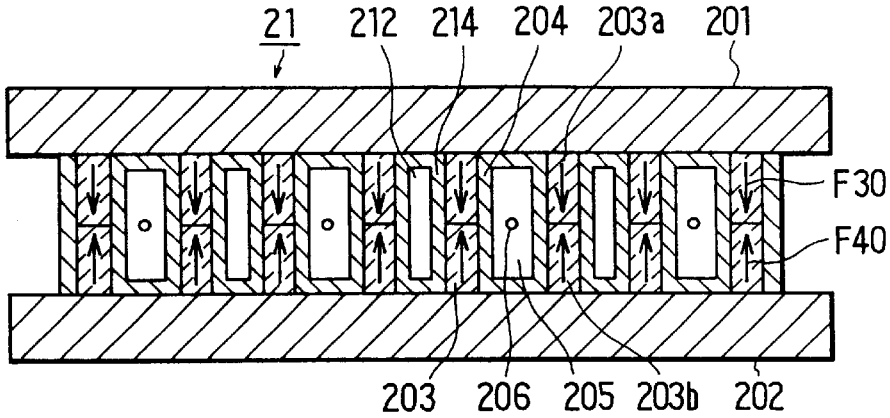
FIG. 8A PRIOR ART
FIG. 8A is a cross-sectional view of a part of a printing head used in the conventional ink-jet printing apparatus.
Figure 8B:
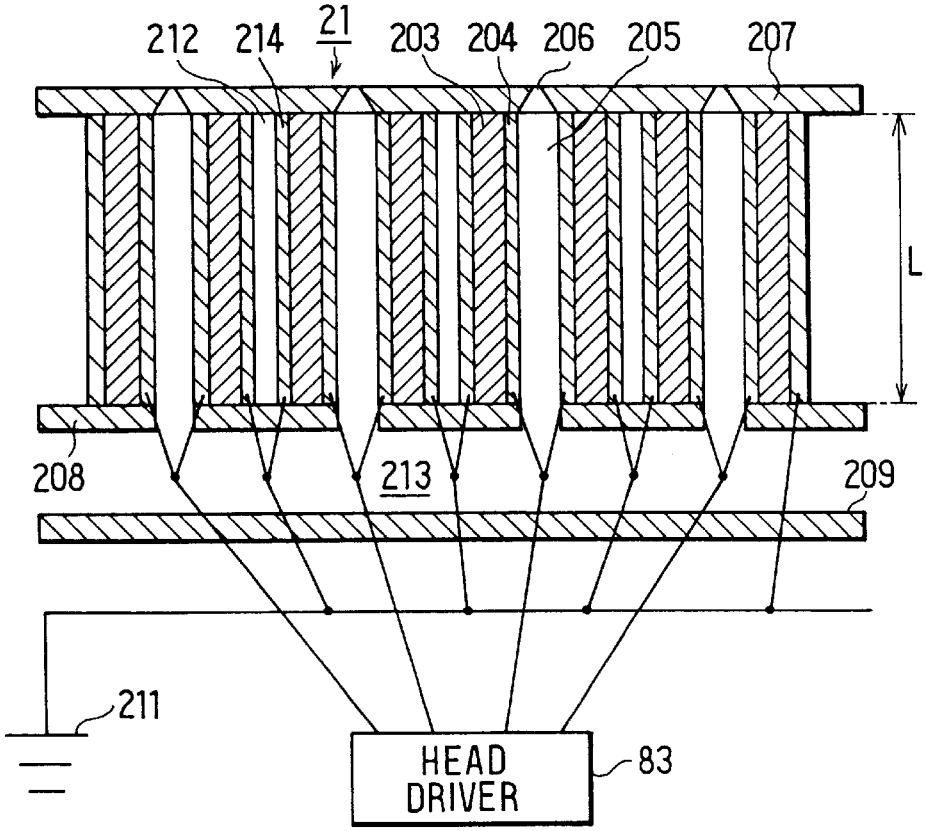
FIG. 8B PRIOR ART
FIG. 8B is a horizontal cross-sectional view of the printing head shown in FIG. 8A.
Figure 9:
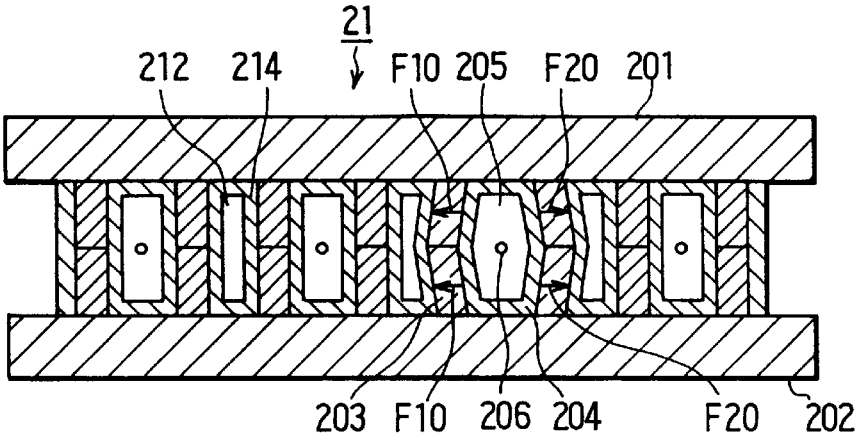
FIG. 9 PRIOR ART
FIG. 9 is a cross-sectional view showing operation of the ink channel in the printing head shown in FIGS. 8A and 8B.
Figure 10:
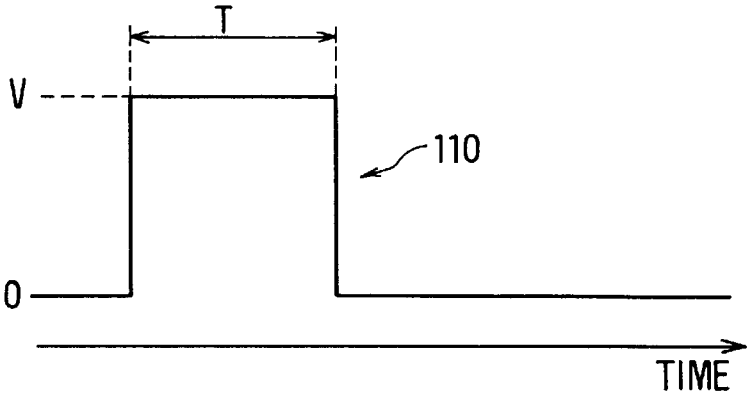
FIG. 10 PRIOR ART
FIG. 10 is a waveform chart of a drive pulse signal applied in the conventional apparatus.

The present invention will now be described in further detail in connection with an embodiment with reference to the accompanying drawings. In the embodiment to follow, an ink-jet printing apparatus is a drop-on-demand ink-jet printing apparatus of a shear mode type using piezoelectric ceramic material shown in FIGS. 8A, 8B and 9.

Figure 1:
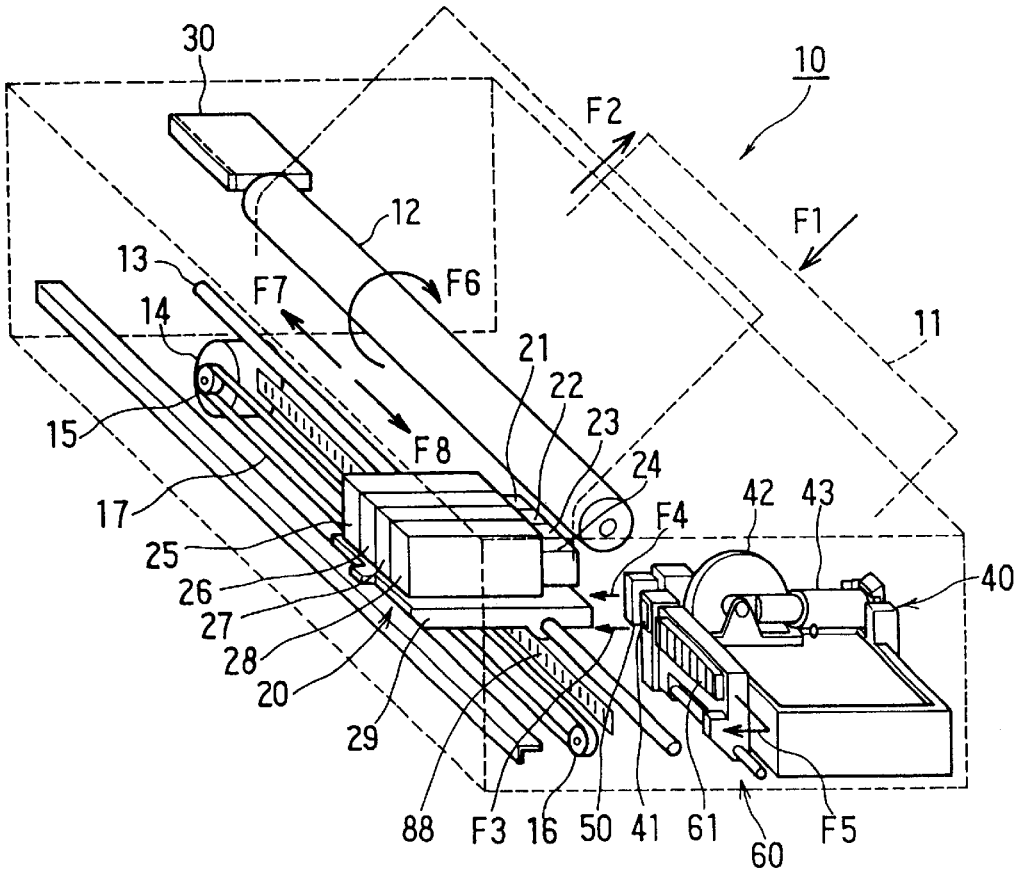
FIG. 1 is a schematic perspective view showing an ink-jet printing apparatus according to an embodiment of the invention.

Referring to FIG. 1, a printing apparatus 10 is provided with a platen roller 12 which rotates in a direction of arrow F6 to feed printable paper 11 in a direction from arrow F1 to arrow F2. Under the platen roller 12, there is provided a carriage shaft 13 in parallel with the axis thereof, and a carriage 29 having a printing head 20 is supported by the carriage shaft 13. A carriage motor 14 is equipped at the lower left of the carriage shaft 13, and a pulley 16 is equipped at the lower right of the carriage shaft 13. A pulley 15 is mounted on a rotor shaft of the carriage motor 14, and an endless belt 17 is hooked between the pulleys 15 and 16.

The carriage 29 is secured on the belt 17. Driven by the carriage motor 14, the carriage 29 slidingly moves on the carriage shaft 13 transversely relative to the printable paper 11, that is, in arrow directions F7 and F8. An encoder member 88 extends along the carriage shaft 13 so that an encoder sensor 87 (FIG. 2) mounted on the carriage 29 detects its position relative to the encoder member 88 during a transverse movement of the carriage 29 relative to the printable paper 11.

The printing head 20 comprises a black-ink head 21 for ejecting black ink, a yellow-ink head 22 for ejecting yellow ink, a cyan-ink head 23 for ejecting cyan ink, and magenta-ink head 24 for ejecting magenta ink. At these heads 21 to 24, ink cartridges 25 to 28 are mounted respectively so that each color ink is supplied to each of the heads 21 to 24. Since the basic internal structure of each of the heads 21 to 24 is the same as in the conventional arrangement shown in FIGS. 8A and 8B, the description thereof is omitted for brevity.

At a predetermined position on the left side of the platen roller 12, which is an outside region of printing with respect to printable paper 11, an ink absorber pad 30 is provided for absorbing ink to be ejected from each of the heads 21 to 24 at the time of flushing operation.

On the right side of the platen roller 12, which is also an outside region of printing, a purge device 40 is provided for removing a possible non-emission or faulty ejection condition from each of the heads 21 to 24. The purge device 40 comprises a suction cap 41 which is used to cover a nozzle-formed part of each of the heads 21 to 24. When each of these heads is set at a purging position, the suction cap 41 is advanced in arrow direction F3 by rotation of a cam 42 so that the nozzle-formed part of each head is covered. Then, a pump 43 is driven to produce negative pressure, whereby unfavorable ink containing air bubbles in an ink channel of each head 21 to 24 is sucked in succession for recovery of the ink ejecting function of the head.

On the left side of the suction cap 41, there is provided a wiper member 50 for removing residual ink and any foreign matter which remains on the nozzle-formed part of each of the heads 21 to 24 after the purging operation. Upon completion of purging each head, the wiper member 50 is advanced in arrow direction F4 to clean up the nozzle-formed part of each of the heads 21 to 24 to be returned into the printing region. Thus, residual ink and any foreign matter are removed from the nozzle-formed part to prevent the printing face of printable paper 11 from being smudged or blotted with ink.

On the right side of the suction cap 41, there is provided a capping device 60 for putting each cap 61 on the nozzle-formed part of each of the heads 21 to 24 when the printing head 20 is reset to a home position thereof. Each cap 61 is advanced in arrow direction F5 when the printing head 20 is reset to the home position, thereby covering the nozzle-formed part of each of the heads 21 to 24. Thus, while the printing apparatus 10 is not in use, ink drying-up is prevented at each of the heads 21 to 24.

Figure 2A:
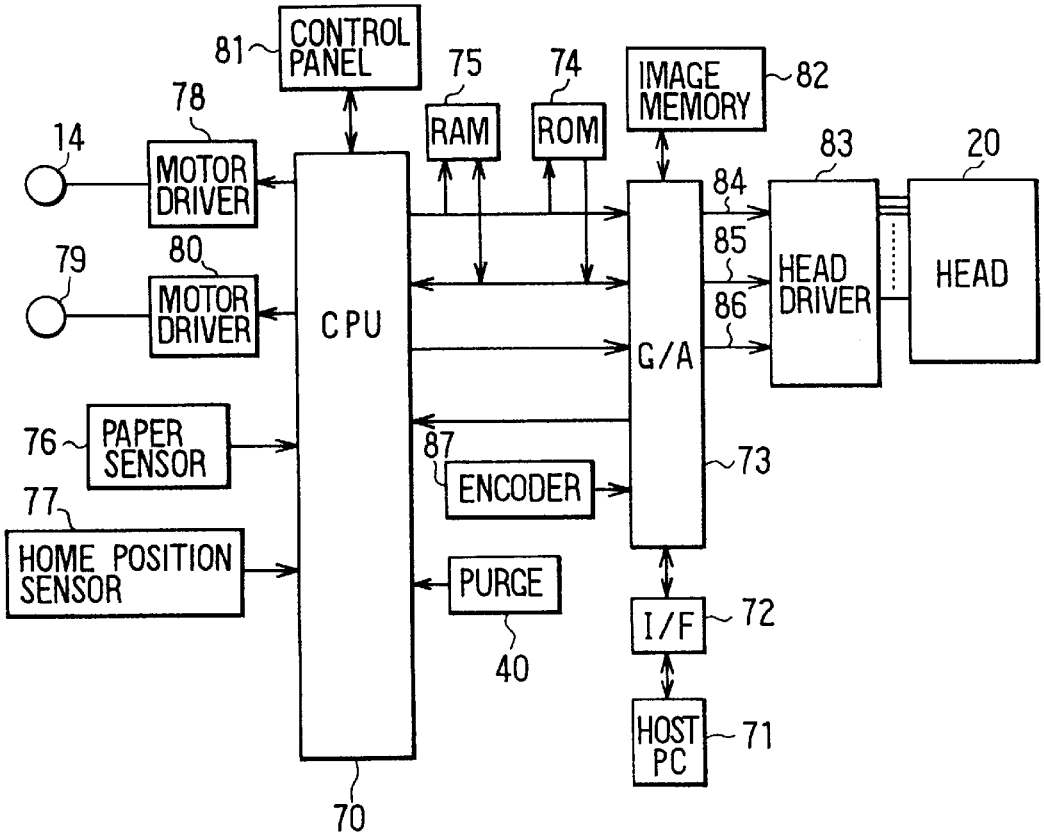
FIG. 2A is a block diagram showing a control circuit used in the embodiment shown in FIG. 1.

Referring to FIG. 2A, there is shown a control circuit of the printing apparatus 10. The control circuit comprises a CPU 70 which issues a printing operation instruction and a flushing instruction to the printing head 20, outputs a purging instruction to the purge device 40 and carries out control of other devices including the above mentioned parts, and a gate array (G/A) 73 which receives printing data from a host computer 71 through an interface (I/F) 72 and carries out control for development of printing data. Between the CPU 70 and the gate array 73, there are provided a ROM 74 which stores control programs, etc. and a RAM 75 which temporarily stores the printing data received from the host computer 71 by the gate array 73. In this arrangement, necessary data are input/output among these parts.

The CPU 70 is connected with a paper sensor 76 for detecting the presence or absence of printable paper 11, a home position sensor 77 for checking whether the printing head 20 is set at the home position thereof, a first motor driver 78 for driving the carriage motor 14, a second motor driver 80 for driving a line feed (LF) motor 79 for rotation of the platen roller 12, a control panel 81 for giving various signals to the CPU 70, etc. The gate array 73 is connected with an image memory 82 in which printing data received from the host computer 71 is temporarily stored as image data. The head driver IC 83 drives the printing head 20 according to printing data 84, a transfer clock signal 85 and a printing clock signal 86 output from the gate array 73.

The gate array 73 is also connected with the encoder sensor 87 to produce the printing clock signal 86 in response to the position of the carriage 29 detected by the encoder sensor 87. It is to be noted that the driving interval of a drive pulse signal 100 (FIG. 3) for the actuator of the printing head 20 is determined by the printing clock signal 86.

Figure 2B:
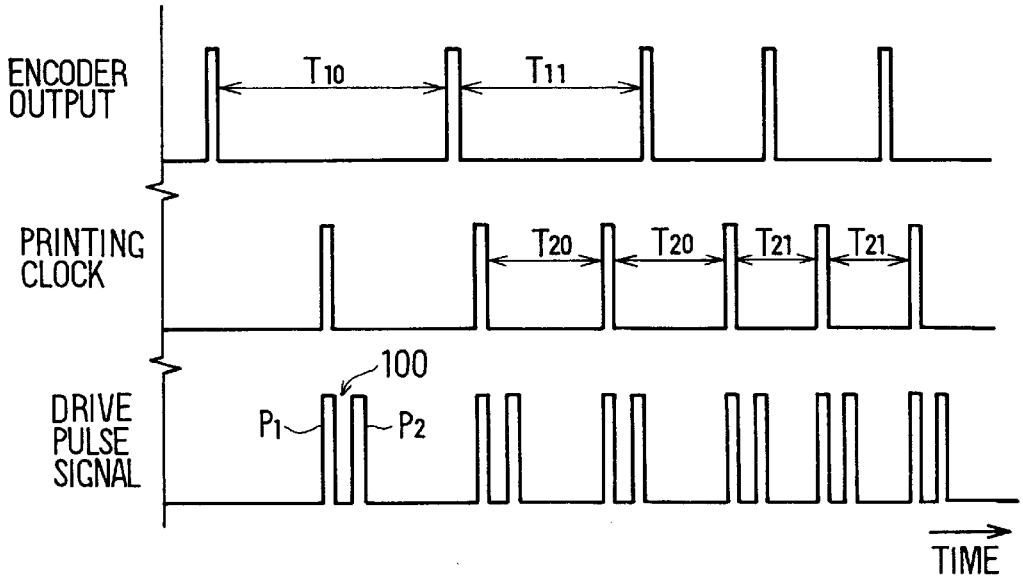
FIG. 2B is a time chart showing signals generated in the control circuit shown in FIG. 2A during a printing operation.

More specifically, as shown in FIG. 2B schematically, the encoder sensor 87 produces an output pulse each time the printing head 20 moves a predetermined distance transversely relative to the printable paper 11. The time intervals T10 and T11 between the encoder outputs may vary with the moving speed of the printing head 20. In this embodiment, the gate array 73 is constructed to responsively produce two printing clock signals for each encoder output. The time intervals T20 and T21 of the printing clock signals vary in proportion to the time intervals T10 and T11. That is, the intervals T20 and T21 are defined as one-half of the intervals T10 and T11, respectively. The head driver IC 83 is constructed to produce the drive signal including two pulses P1 and P2 in synchronism with the printing clock signal.

Figure 3:
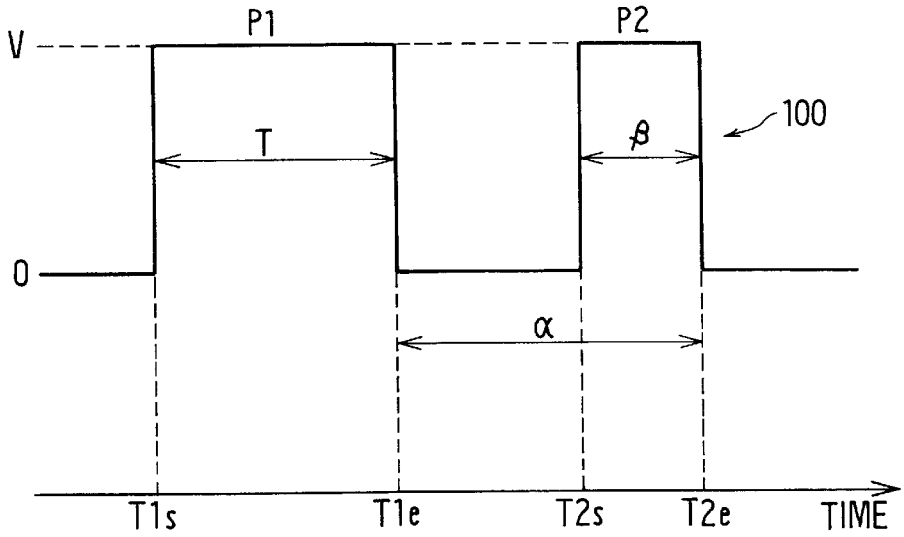
FIG. 3 is a waveform chart of a drive pulse signal shown in FIG. 2B.

As shown in FIG. 3 in detail, each drive pulse signal 100 supplied to each head of the printing head 20 from the head driver IC 83 comprises the first drive pulse P1 which rises at time T1s and falls at time T1e for ejecting ink and the second drive pulse P2 which rises at time T2s and falls at time T2e for compensating for variation in residual pressure in the ink channel 205 after ink ejection. The first drive pulse P1 and second drive pulse P2 have the same wave magnitude H.

The first drive pulse P1 has the pulse width T which corresponds to the one-way propagation time T (L/a) of pressure wave in the ink channel 205. The second drive pulse P2 has a pulse width β which is in the range between 0.20T and 0.40T. Further, the second drive pulse P2 is so generated that it falls at time T2e within a time period a which is in a range between 2.60T and 2.80T from the fall time T1e of the first drive pulse P1. It is to be noted that the second drive pulse P2 is not for ejecting ink but for suppressing the residual pressure wave vibration caused by the first drive pulse P1 in the ink chamber 205. In this embodiment, the magnitudes H of the drive pulses P1 and P2 are both 19 volts. The pulse width T and time period α are set to 17 μs and 44.2 μs–47.6 μs, respectively.

Figure 4:
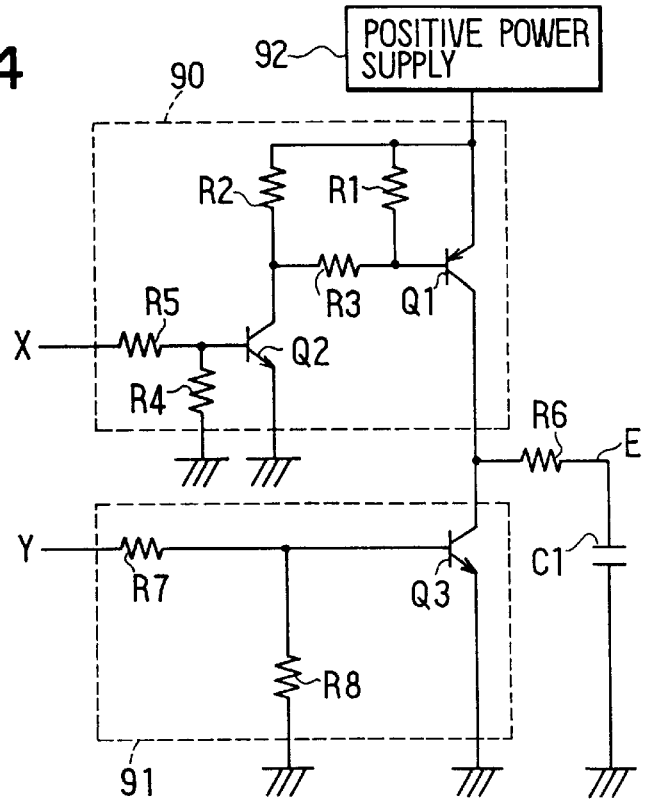
FIG. 4 is an electric wiring diagram of a head driver circuit used in the embodiment shown in FIG. 1.

Referring to FIG. 4 showing the head driver IC 83, with input signals X and Y, a drive voltage applied to the electrode 204 of the ink channel 205 is set to level V or 0 (zero). When the input signal X turns on, a drive voltage is applied, and when the input signal Y turns on, a drive voltage becomes 0 (zero). A capacitor C1 is provided by the shear mode actuator wall 203 of the ink channel 205 and a pair of electrodes 204 and 214 formed on both sides thereof.

The drive circuit comprises an ejection charge circuit 90 and an ejection discharge circuit 91. When the input signal X turns on, it is fed to a base of transistor Q2 through resistor R5 to turn on transistor Q2. Then, since a base potential at transistor Q1 decreases when transistor Q2 turns on, transistor Q1 turns on to apply voltage, e.g., 22 volts from a positive power supply 92 to capacitor C1 (voltage E). When the input signal Y turns on, it is fed to a base of transistor Q3 through resistor R7 to turn on transistor Q3, thereby grounding capacitor C1 (voltage E) through resistor R6.

Figure 5:
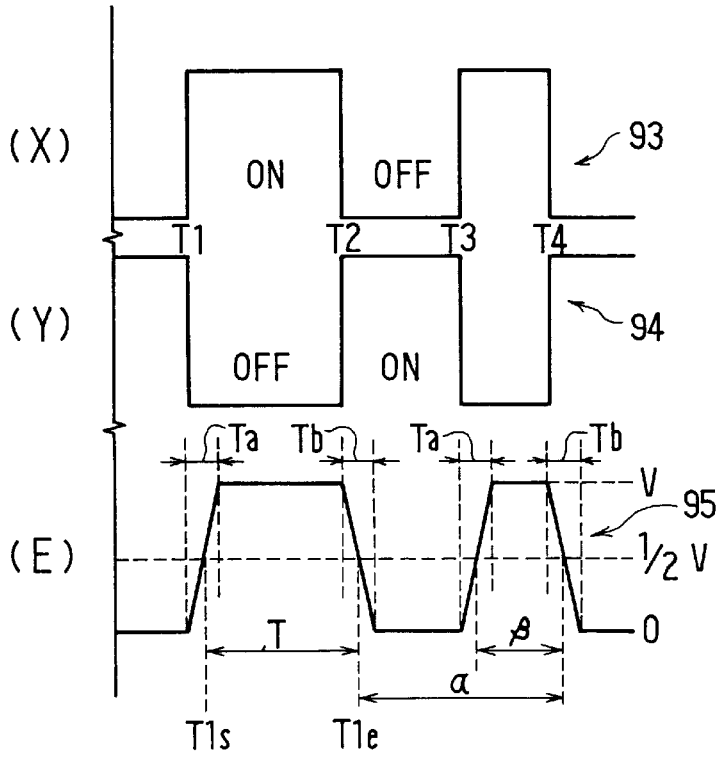
FIG. 5 is a time chart showing a relationship between input signals X and Y and waveform of voltage E in the embodiment shown in FIG. 1.

Referring to FIG. 5, there is shown a relationship between timings of the input signals X and Y for the drive pulse signal and waveform of voltage E across the capacitor C1.

The input signal X indicated in a timing chart 93 remains off normally. The input signal X turns on (rises) at a predetermined time T1 of ink droplet ejection and it turns off (falls) at a predetermined time T2. Then, the input signal X turns on at a predetermined time T3 and it turns off at a predetermined time T4. As indicated in timing chart 94, the input signal Y turns off when the input signal X turns on and it turns on when the input signal X turns off.

In a timing chart 95 showing an actual waveform of voltage E, timings T1s, T1e, T2s and T2e are used in correspondence with FIG. 3 and a dotted line between 0 and V (e.g., 22 volts) indicates V/2 (e.g., 11 volts). The voltage E remains 0 volt normally. At the predetermined time T1, capacitor C1 is charged, and voltage E is increased to the height V after a lapse of a charge time Ta which is determined by transistor Q1, resistor R6 and capacitor C1. Then, at the predetermined time T2, capacitor C1 is discharged, and voltage E is decreased to 0 volt after a lapse of a discharge time Tb which is determined by transistor Q3, resistor R6 and capacitor C1. Thereafter, at the predetermined time T3, capacitor C1 is charged, and voltage E is decreased to 0 volt after the lapse of the discharge time Tb.

Ink ejection performance in which the printing head 20 was driven using the drive pulse signal 100 (more specifically as shown in FIG. 5) was analyzed with respect to the ejection speed v of the ink droplets. In this performance test, the ink chamber 205 of the printing head 20 was set to have the length L=12 mm. The nozzle 206 was set to have the length L'=100 μm, the diameter D1=35 μm at the ink ejection side and the diameter D2=72 μm at the side of the ink chamber 205. Further, the test was conducted in the ambient temperature at 25° C. The viscosity and surface tension of ink at this temperature was 4.5 mPa·s and 40 mN/m, respectively. The one-way propagation time T (L/a) in the ink within the ink chamber 205 was 17 μs.

In the test, the magnitude of the drive pulse signal 100 was set to 19 volts (same as the conventional drive pulse 110). The drive pulse signal 100 was generated at every driving interval of 100 μs (10 kHz) and interval of 200 μs (5 kHz) variably. The time period a from the fall time T1e of the first drive pulse P1 and the fall time T2e of the second drive pulse P2 was varied between 2.50T (42.5 μs) and 2.90 T (49.3 μs), while the pulse width β of the second drive pulse P2 was varied between 0.15T (2.6 μs) and 0.50T (8.5 μs).

Figures 6, 7:
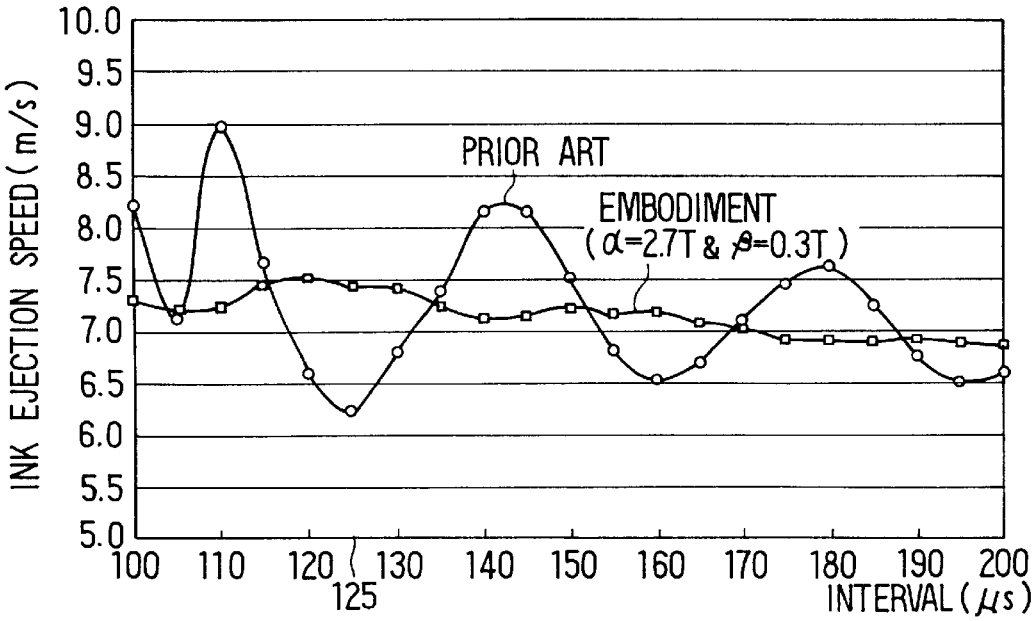
FIG. 6 is a table showing the results of experiment on ink droplet ejection in the embodiment shown in FIG. 1.
FIG. 7 is a graph showing the measured relation between driving interval and ink ejection speed in the conventional ink-jet printing apparatus and the embodiment shown in FIG. 1.

The performance test result is shown in the table of FIG. 6 in which marks ◎, ○, Δ and X indicate evaluation of variations Δv in the measured ejection speed v. As understood from this performance test, the variation Δv is small (○) as long as α is between 2.60T and 2.80T and β is between 0.20T and 0.40T, while the variation Δv becomes much smaller (◎) as long as α is between 2.65T and 2.75T and β is between 0.25T and 0.35T.

Among various combinations of α and β0 which caused a least variation (marked ◎), the drive pulse signal 100 was particularly set to have the pulse width T=17 μs, pulse width β=5.1 μs (0.30T) and time period α=45.9 μs (2.70T) and its ink ejection speed v was measured at different driving intervals. This measured speed is shown in FIG. 7 in comparison with the conventional case. As understood from FIG. 7, the speed becomes 7.5 m/s (higest) at the driving interval of 120 μs and becomes 6.8 m/s (lowest) at the driving interval of 200 μs (driving frequency of 5 kHz). Thus, the maximum variation in the ink ejection speed is reduced remarkably to 0.7 m/s by the drive pulse signal 100 in this embodiment than by the drive pulse signal 110 in the conventional apparatus in which the maximum variation is 2.75 m/s.

It was also ascertained that, as long as the speed variation Δv is less than 2.0 m/s as indicated by the marks ◎, ○, Δ other than X in FIG. 6, the printing quality can be assured. That is, the pulse width β of the second drive pulse P2 may be set between 0.20T and 0.40T and the time period α may be set between 2.60T and 2.80T to suppress the residual pressure wave vibration in the ink chamber 205 and reduce variation Δv in the ink ejection speed.

The above embodiment may be modified as follows. Although the positive power supply 92 is used in the embodiment, a negative power supply may be used so that the shear mode actuator wall 203 may be polarized in the directions opposite to arrows F30 and F40 indicated in FIG. 8A. Also, while the upper wall 203*a* and the lower wall 203*b* of the shear mode actuator wall 203 are deformed by means of piezoelectric thickness slip deformation to change the volume of the ink channel 205 for ejecting ink droplets, it is possible to provide an arrangement that one of the upper wall 203*a* and the lower wall 203*b* is made of any material not allowing piezoelectric thickness slip deformation and the other wall allowing piezoelectric thickness slip deformation is deformed to change the volume of the ink channel 205 for emitting ink droplets.

Still more, while the air channel 212 is provided on both sides of the ink channel 205 in the embodiment, it is to be understood that ink channels may be arranged adjacently without providing any air channel. In addition, the driving frequency of the printing head 20 may be determined not only by the movement of the carriage 29 but also by the movement of the printable paper 11 (particularly in the case of non-movable carriage) and/or other parameters which may affect printing quality.

The present invention should not be limited to the disclosed embodiment and modifications but may be implemented in various ways without departing from the spirit of the invention.

What is claimed is:

1. An ink-jet printing apparatus comprising:

a printing head having an ink channel, an actuator for changing a volume of the ink channel and a nozzle connected with the ink channel to eject the ink from the ink channel onto a printable medium; and a drive circuit connected to the printing head for applying a drive pulse signal including a first drive pulse to the actuator so that the ink channel expands a volume thereof to generate a pressure wave in the ink channel and, after a lapse of an approximate odd-numbered multiple of one-way propagation time T of the pressure wave in the ink channel, an expanded volume of the ink channel is decreased to normal state thereof to apply pressure to the ink in the ink channel for ejecting the ink from the ink channel through the nozzle, wherein the drive circuit, after applying the first drive pulse to the actuator, applies to the actuator a second drive pulse which has a magnitude substantially equal to that of the first drive pulse and a pulse width equal to approximately 0.20 to 0.40 times the one-way propagation time T so that an end time of the second drive pulse falls in a range of approximately 2.60 to 2.80 times the one-way propagation time T from an end time of the first drive pulse.

2. The ink-jet printing apparatus according to claim 1, wherein the actuator includes at least one wall part defining the ink channel and at least one area of the wall part is formed by a material which vibrates mechanically.

3. The ink-jet printing apparatus according to claim 2, wherein the material includes a piezoelectric element.

4. The ink-jet printing apparatus according to claim 1, wherein the pulse width of the second drive pulse is in a range of approximately 0.25 to 0.35 times the one-way propagation time T.

5. The ink-jet printing apparatus according to claim 1, wherein the end time of the second drive pulse falls in a range of approximately 2.65 to 2.75 times the one-way propagation time T from the end time of the first drive pulse.

6. The ink-jet printing apparatus according to claim 5, wherein the pulse width of the second drive pulse is in a range of approximately 0.25 to 0.35 times the one-way propagation time T.

7. The ink-jet printing apparatus according to claim 1, further comprising:

an electric drive mechanism coupled with the printing head for moving the printing head against the printable medium during a printing operation; and a sensor provided to detect a movement of the printing head relative to the printable medium, wherein the drive circuit is connected to the sensor to control a driving interval of the drive pulse signal in response to the detected movement of the printing head.

8. The ink-jet printing apparatus according to claim 7, wherein the pulse width of the second drive pulse is in a range of approximately 0.25 to 0.35 times the one-way propagation time T.

9. The ink-jet printing apparatus according to claim 7, wherein the end time of the second drive pulse falls in a range of approximately 2.65 to 2.75 times the one-way propagation time T from the end time of the first drive pulse.

10. The ink-jet printing apparatus according to claim 7, wherein the pulse width of the second drive pulse is approximately 0.30 times the one-way propagation time T and the end time of the second drive pulse falls at approximately 2.70 times the one-way propagation time T from the end time of the first drive pulse.

11. An ink-jet printing control method comprising the steps of:

causing a relative movement between a printing head and a printable medium, the printing head having an ink channel, an actuator for changing a volume of the ink channel and a nozzle connected with the ink channel to eject the ink from the ink channel onto the printable medium;

detecting a relative movement between the printing head and the printable medium;

driving the actuator by a first drive pulse in relation to the detected relative movement so that the ink channel expands a volume thereof to generate a pressure wave in the ink channel and, after a lapse of an approximate odd-numbered multiple of one-way propagation time T of the pressure wave in the ink channel, an expanded volume of the ink channel is decreased to normal state thereof to apply pressure to the ink in the ink channel for ejecting the ink from the ink channel through the nozzle; and driving the actuator after the first drive pulse by a second drive pulse which has a pulse width equal to approximately 0.20 to 0.40 times the one-way propagation time T so that an end time of the second drive pulse falls in a range of approximately 2.60 to 2.80 times the one-way propagation time T from an end time of the first drive pulse.

12. The ink-jet printing control method according to claim 11, wherein the pulse width of the second drive pulse is in a range of approximately 0.25 to 0.35 times the one-way propagation time T.

13. The ink-jet printing control method according to claim 11, wherein the end time of the second drive pulse falls in a range of approximately 2.65 to 2.75 times the one-way propagation time T from the end time of the first drive pulse.

14. The ink-jet printing control method according to claim 11, wherein the pulse width of the second drive pulse is approximately 0.30 times the one-way propagation time T and the end time of the second drive pulse falls at approximately 2.70 times the one-way propagation time T from the end time of the first drive pulse.

15. The ink-jet printing control method according to claim 11, wherein the second drive pulse has a same magnitude as the first drive pulse.

* * * * *